US006461668B2

(12) United States Patent
Hirayama et al.

(10) Patent No.: US 6,461,668 B2
(45) Date of Patent: Oct. 8, 2002

(54) METHOD AND APPARATUS FOR MANUFACTURING CATHODE RAY TUBE

(75) Inventors: Kazumasa Hirayama, Yokohama; Yuzuru Sasaki, Fukaya, both of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/339,687

(22) Filed: Jun. 24, 1999

(65) Prior Publication Data

US 2001/0004468 A1 Jun. 21, 2001

(30) Foreign Application Priority Data

Jun. 26, 1998 (JP) ..... 10-181088

(51) Int. Cl.[7] ..... B05D 5/06; B05D 5/123; B05D 3/10

(52) U.S. Cl. ..... 427/64; 427/66; 427/68

(58) Field of Search ..... 427/64, 66, 68

(56) References Cited

U.S. PATENT DOCUMENTS 4,917,978 A * 4/1990 Ritt et al. ..... 430/23
5,086,397 A * 2/1992 Schuster et al. ..... 364/468
5,089,743 A * 2/1992 Okuda et al. ..... 313/474
5,112,179 A * 5/1992 Chan et al. ..... 412/1

* cited by examiner

*Primary Examiner*—Shrive P. Beck
*Assistant Examiner*—Michael Cleveland
(74) *Attorney, Agent, or Firm*—Oblon, Spivak, McClelland, Maier & Neustadt, P.C.

(57) ABSTRACT

Disclosed is a method of manufacturing a cathode ray tube, in which an untreated panel for a cathode ray tube is supplied to a phosphor screen-forming line including a black film-forming step for forming a black film, a phosphor film-forming step for forming a phosphor film, and an aluminum film-forming step for forming an aluminum film to form a pattern of a phosphor screen consisting of the black film, the phosphor film and the aluminum film on the inner surface of the panel. The manufacturing method includes the steps of rejecting from the phosphor screen-forming line at least one defective panel selected from the group consisting of a panel defective in the black film, a panel defective in the phosphor film and a panel defective in the aluminum film, recycling the rejected defective panel to the phosphor screen-forming line, and forming again a pattern of a phosphor screen consisting of a black film, a phosphor film and an aluminum film on the inner surface of the panel recycled to the phosphor screen-forming line. Where the untreated panel for the cathode ray tube conflicts with the rejected defective panel at a starting point of the phosphor screen-forming line, the defective panel is supplied in preference to the untreated panel to the phosphor screen-forming line.

21 Claims, 5 Drawing Sheets

METHOD AND APPARATUS FOR MANUFACTURING CATHODE RAY TUBE

BACKGROUND OF THE INVENTION

The present invention relates to a method and an apparatus for manufacturing a cathode ray tube, particularly, to formation of a phosphor screen of a cathode ray tube.

As shown in FIGS. 1 to 3, a phosphor screen 5 consisting of a black film 2, three phosphor films 3*a*, 3*b*, 3*c* of green, blue and red, and an aluminum film 4 formed to cover the black film 2 and the phosphor films is formed on the inner surface of a panel 1 of a cathode ray tube. Incidentally, FIG. 1 is a side cross sectional view of the panel 1, FIG. 2 is a front view of the panel 1, and FIG. 3 is a cross sectional view showing in a magnified fashion a part of the panel 1.

As shown in FIG. 4, a phosphor screen-forming apparatus 8 for forming the phosphor screen on the inner surface of the panel 1 comprises a black film-forming section 8*a* for forming the black film, a phosphor film-forming section 8*b* for forming the three phosphor films 3*a*, 3*b*, 3*c*, and an aluminum film-forming section 8*c* for forming the aluminum film to cover the black film and the phosphor films by vacuum vapor deposition.

In the phosphor screen-forming apparatus 8, it is difficult to achieve 100% of yield in each section and, thus, defective articles are unavoidably generated. To be more specific, a panel 1A defective in the black film is generated in the black film-forming section 8*a*. Also, a panel 1B defective in the phosphor films is generated in the phosphor film-forming section 8*b*. Further, a panel 1C defective in the aluminum film is generated in the aluminum film-forming section 8*c*.

The defect is derived from the shadow mask used in combination with the panel for the pattern formation and from the panel itself. Since the black film or the phosphor film is formed by directly coating the inner surface of the panel with the film material, the black film or the phosphor film is rendered defective if dust or a foreign matter is attached to the inner surface of the panel in the coating step.

Also, if the development and the drying are insufficient, it is impossible to form the black film or the phosphor film in a desired pattern making the formed film defective. It is also possible for the three kinds of phosphors to be mixed with each other and for the phosphor particles to fail to be attached strongly to the inner surface of the panel, leading to the defective phosphor film. For example, the green light-emitting phosphor may possibly be mixed with the red or blue light-emitting phosphor to make the formed phosphor film defective.

The defective aluminum film includes typically a film defective in thickness and a film containing dust or a foreign matter.

The defective film is also derived from the defectiveness of the shadow mask including the defective pore size of the shadow mask and deformation of the shadow mask. Since the panel is exposed to light through the shadow mask that is kept in tight contact with the panel, a satisfactory phosphor film cannot be formed no matter how many times the phosphor coating, light exposure and development may be repeated, unless the shadow mask itself is corrected. Where the shadow mask cannot be corrected, it is necessary to return to the preceding step to replace the shadow mask and to align the shadow mask with the panel.

For forming the phosphor screen 5, the inner surface of the panel 1 is washed in general as a pretreatment of the phosphor screen-forming step. Specifically, an industrial water, hydrofluoric acid and pure water are successively sprayed against the inner surface of a new panel to remove the foreign matter, dust, etc. attached to the inner surface of the new panel, followed by drying the panel and subsequently coating the washed inner surface of the panel with resist to form a primary coat for forming the black film 2.

On the other hand, the defective panels 1A, 1B, 1C are loaded again in the phosphor screen-forming apparatus 8 shown in FIG. 4 like the new panel. Within the phosphor screen-forming apparatus 8, the defective aluminum film 4, the defective phosphor film 3 and the defective black film 2 are washed away by a panel washing device. Then, the film forming steps are redone starting with the initial step of the black film-forming step, like the new panel.

In the conventional phosphor screen-forming apparatus, the panels having the films formed thereon are inspected at the outlets of the black film-forming section 8*a*, the phosphor film-forming section 8*b* and the aluminum film-forming section 8*c*, and the defective panels are manually rejected from the manufacturing line so as to be transferred by a transfer means such as a carriage and supplied again to the black film-forming section. However, normal panels transferred from the upstream steps must be supplied into the black film-forming section, making it difficult to control the loading of the rejected panels at the inlet of the black film-forming section 8*a*. It is also difficult to control the recovery of the defective panels.

BRIEF SUMMARY OF THE INVENTION

An object of the present invention is to provide a method of manufacturing a cathode ray tube that makes it possible to form again a phosphor screen on a panel once rejected as a defective panel so as to manufacture a cathode ray tube efficiently while decreasing the manual labor requirement.

Another object of the present invention is to provide an apparatus for manufacturing a cathode ray tube that makes it possible to form again a phosphor screen on a panel once rejected as a defective panel so as to manufacture a cathode ray tube efficiently while decreasing the manual labor requirement.

According to an aspect of the present invention, there is provided a method of manufacturing a cathode ray tube, in which an untreated panel for a cathode ray tube is supplied to a phosphor screen-forming line including a black film-forming step for forming a black film, a phosphor film-forming step for forming a phosphor film, and an aluminum film-forming step for forming an aluminum film to form a patterned phosphor screen consisting of the black film, the phosphor film and the aluminum film on the inner surface of the panel, comprising the steps of rejecting from the phosphor screen-forming line at least one defective panel selected from the group consisting of the panel defective in the black film formed in the black film-forming step, the panel defective in the phosphor film formed in the phosphor film-forming step, and the panel defective in the aluminum film formed in the aluminum film-forming step, recycling the rejected defective panel to the starting point of the phosphor screen-forming line, and forming again a pattern of a phosphor screen consisting of the black film, the phosphor film and the aluminum film on the inner surface of the panel recycled to the phosphor screen-forming line, wherein, where the untreated panel for the cathode ray tube conflicts with the rejected defective panel at a starting point of the phosphor screen-forming line, the defective panel is supplied in preference to the untreated panel to the phosphor screen-forming line.

According to another aspect of the present invention, there is provided an apparatus for manufacturing a cathode ray tube, comprising a phosphor screen-forming device including a black film-forming section for forming a black film, a phosphor film-forming section for forming a phosphor film and an aluminum film-forming section for forming an aluminum film and serving to form a pattern of a phosphor screen consisting of the black film, the phosphor film and the aluminum film on the inner surface of an untreated panel for a cathode ray tube, an untreated panel transfer device for transferring the untreated panel for the cathode ray tube to a region near the phosphor screen-forming device, a first delivery device for delivering the untreated panel for the cathode ray tube from the untreated panel transfer device onto the phosphor screen-forming device, a rejecting device for rejecting from the phosphor screen-forming device at least one defective panel selected from the group consisting of the panel defective in the black film formed in the black film-forming section, the panel defective in the phosphor film formed in the phosphor film-forming section, and the panel defective in the aluminum film formed in the aluminum film-forming section, a defective panel transfer device for transferring the rejected defective panel to a region near the starting point of the phosphor screen-forming device, a second delivery device for delivering the defective panel transferred to a region near the starting point of the phosphor screen-forming device into the phosphor screen-forming device, and a control device for controlling the rejecting device, the defective device transfer device and the first and second delivery devices such that, when the untreated panel for the cathode ray tube conflicts with the rejected defective panel at a starting point of the phosphor screen-forming device, the defective panel is supplied in preference to the untreated panel into the phosphor screen-forming device.

According to another aspect of the present invention, there is provided a method of manufacturing a cathode ray tube, in which an untreated panel for a cathode ray tube is supplied to a phosphor screen-forming line including a black film-forming step for forming a black film, a phosphor film-forming step for forming a phosphor film, and an aluminum film-forming step for forming an aluminum film to form a patterned phosphor screen consisting of the black film, the phosphor film and the aluminum film on the inner surface of the panel, comprising the steps of rejecting from the phosphor screen-forming line at least one defective panel selected from the group consisting of the panel defective in the black film formed in the black film-forming step, the panel defective in the phosphor film formed in the phosphor film-forming step, and the panel defective in the aluminum film formed in the aluminum film-forming step, storing information in memory means on the rejected defective panel, recycling the rejected defective panel to the starting point of the phosphor screen-forming line, reading the information stored in advance in the memory means on the rejected defective panel, and forming again a pattern of a phosphor screen consisting of the black film, the phosphor film and the aluminum film on the inner surface of the panel recycled to the phosphor screen-forming line, wherein, where the untreated panel for the cathode ray tube conflicts with the rejected defective panel at a starting point of the phosphor screen-forming line, the rejected defective panel is supplied in preference to the untreated panel into the phosphor screen-forming line in accordance with the information on the rejected defective panel read from the memory means.

Further, according to still another aspect of the present invention, there is provided an apparatus for manufacturing a cathode ray tube, comprising a phosphor screen-forming device including a black film-forming section for forming a black film, a phosphor film-forming section for forming a phosphor film and an aluminum film-forming section for forming an aluminum film and serving to form a pattern of a phosphor screen consisting of the black film, the phosphor film and the aluminum film on the inner surface of an untreated panel for a cathode ray tube, an untreated panel transfer device for transferring the untreated panel for the cathode ray tube to a region near the starting point of the phosphor screen-forming device, a first reading means for reading the information on the untreated panel for the cathode ray tube, a first delivery device for delivering the untreated panel for the cathode ray tube from the untreated panel transfer device into the phosphor screen-forming device in accordance with the information on the untreated panel for the cathode ray tube that has been read by the first reading means, a rejecting device for rejecting from the phosphor screen-forming device at least one defective panel selected from the group consisting of the panel defective in the black film formed in the black film-forming section, the panel defective in the phosphor film formed in the phosphor film-forming section, and the panel defective in the aluminum film formed in the aluminum film-forming section, a defective panel transfer device for transferring the rejected defective panel to a region near the starting point of the phosphor screen-forming device, memory means mounted to the defective panel transfer device for storing the information on the defective panel, writing means for writing the information on the defective panel in the memory means, second reading means for reading the information on the defective panel stored in the memory means, a second delivery device for delivering the defective panel transferred to a region near the starting point of the phosphor screen-forming device into the phosphor screen-forming device in accordance with the information on the defective panel read by the second reading means, and a control device for controlling the operations of the rejecting device and the writing means and for controlling the first and second delivery devices such that, when the untreated panel for the cathode ray tube conflicts the rejected defective panel at a starting point of the phosphor screen-forming device, the defective panel is supplied in preference to the untreated panel into the phosphor screen-forming device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
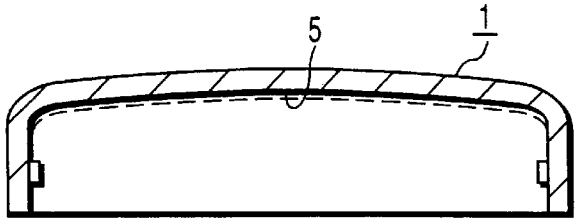
FIG. 1 is a cross sectional view showing a panel of an ordinary cathode ray tube.
Figure 2:
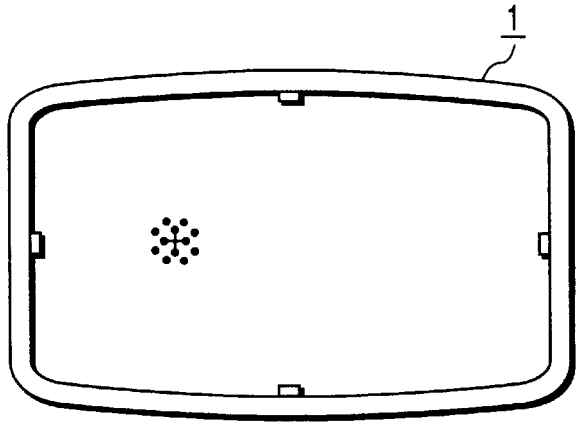
FIG. 2 is a bottom view of the cathode ray tube panel shown in FIG. 1.
Figure 3:
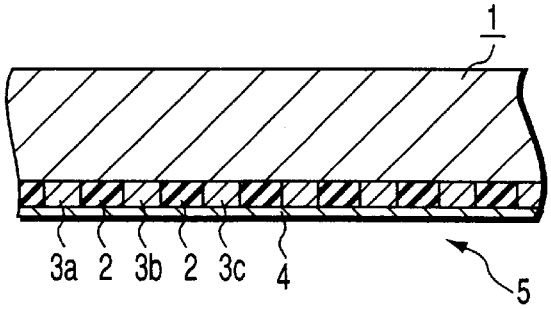
FIG. 3 is a cross sectional view showing in a magnified fashion the cathode ray tube panel shown in FIG. 1.
Figure 4:
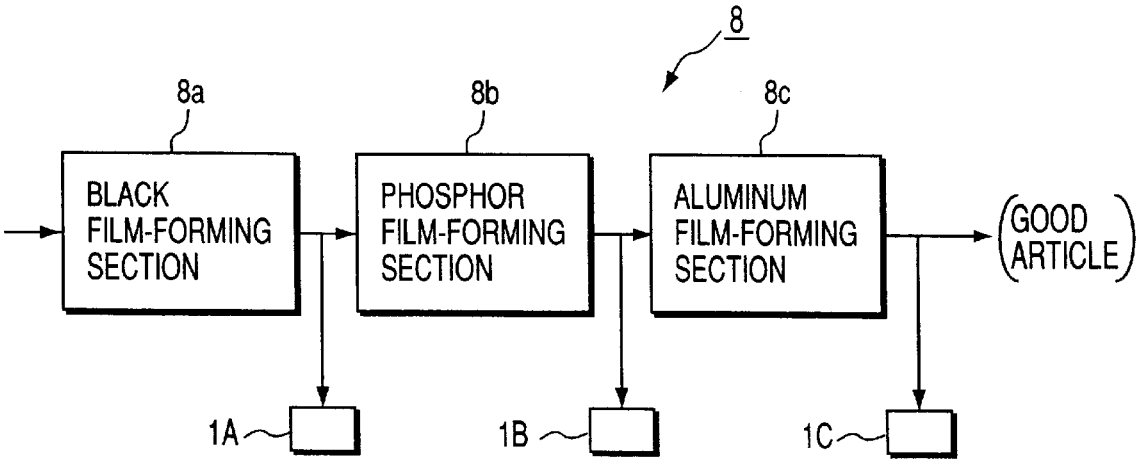
FIG. 4 is a block diagram showing the conventional process for forming a phosphor screen of a cathode ray tube.

The present invention provides a method of manufacturing a cathode ray tube. In the present invention, at least one defective panel selected from the group consisting of a panel defective in a black film formed in a black film-forming step, a panel defective in a phosphor film formed in a phosphor film-forming step, and a panel defective in an aluminum film formed in an aluminum film-forming step is automatically rejected from a phosphor screen-forming line, and the rejected defective panel is recycled to the starting point of the phosphor screen-forming line. Where untreated panel for the cathode ray tube conflicts with the rejected defective panel at the starting point of the phosphor screen-forming line, the defective panel is supplied in preference to the untreated panel into the phosphor screen-forming line.

The present invention also provides an apparatus for manufacturing a cathode ray tube. The apparatus of the present invention comprises a rejecting device for rejecting from the phosphor screen-forming device at least one defective panel selected from the group consisting of the panel defective in the black film, the panel defective in the phosphor film, and the panel defective in the aluminum film, a defective panel transfer device for transferring the rejected defective panel to a region near the starting point of the phosphor screen-forming device, a second delivery device for delivering the defective panel transferred to a region near the starting point of the phosphor screen-forming device into the phosphor screen-forming device, and a control device for controlling the operations of each of these devices such that, when the untreated panel for the cathode ray tube conflicts with the rejected defective panel at the starting point of the phosphor screen-forming device, the defective panel is supplied in preference to the untreated panel to the phosphor screen-forming device.

In the method and apparatus of the present invention, a panel defective in the black film, phosphor film or aluminum film is automatically rejected from the phosphor screen-forming line so as to be recycled to the starting point of the phosphor screen-forming line. The particular technique makes it possible to manufacture a cathode ray tube efficiently, while decreasing the manual labor.

Where a rejected defective panel conflicts with an untreated panel at the starting point of the phosphor screen-forming line, the rejected defective panel is classified in preference to the untreated panel depending on the kind of the panel, and delivered into the phosphor screen-forming line. Therefore, the panel delivered first into the phosphor screen-forming line is treated first. That is, so-called "first-in and first-out" manufacture of the panel can be performed. Incidentally, the defective panel conflicts with the untreated panel where the defective panel and the untreated panel are of the same kind.

It is possible to arrange a black film inspecting step for inspecting a black film, a phosphor film inspecting step for inspecting a phosphor film and an aluminum film inspecting step for inspecting an aluminum film after the black film-forming step, the phosphor film-forming step and the aluminum film-forming step, respectively, so as to reject the panel determined to be defective in any of these inspecting steps from the phosphor screen-forming line.

Where the number of times of rejection exceeds a predetermined value, it is possible to prevent the panel from being recycled to the phosphor screen-forming line. As a result, the defective panel is prevented from being treated uselessly many times.

It is also possible to employ a washing step for washing the inner surface of the panel for the cathode ray tube before the phosphor screen-forming line. In this case, the degree of washing in the washing step can be determined depending on the kind of the rejection step.

The defective panel transfer device comprises a transfer tool having a memory device mounted thereto. Also, it is possible for the apparatus of the present invention to comprise further a writing device for writing in the memory device the information on the panel rejected by the rejecting device. The information on the panel rejected by the rejecting device and written in the memory device by the writing device can be taken out easily.

In the apparatus of the present invention, a reading device for reading the panel information is mounted to the delivery device. Also, a counter for counting the number of times of rejection of the defective panel based on the panel information read by the reading device is mounted to the control device. Where the number of times of rejection has reached a predetermined value, loading of the rejected panel to the phosphor screen-forming line is inhibited. It follows that the panel recovery is not repeated uselessly many times.

The panel information includes the kind of the panel, the panel number, the number of times of rejection, and the contents of the defectiveness. Supply of the panel to the phosphor screen-forming line can be controlled based on the panel information. It is also possible to write in the memory device as the panel information the manufacturing conditions such as the panel temperature and the number of the light exposure device used so as to provide a data collecting means for tracing the causes of the defectiveness.

The apparatus of the present invention may also comprise a panel washing device for detecting whether the panel is new or defective in the black film, the phosphor film or the aluminum film and for washing the panel depending on the contents of the detected defectiveness. Since the panel washing device automatically detects the new panel and the defective panel and performs a washing treatment to the defective panel depending on the type of defect, the washing quality can be stabilized.

Various embodiments of the present invention will now be described with reference to the accompanying drawings.

Figure 5:
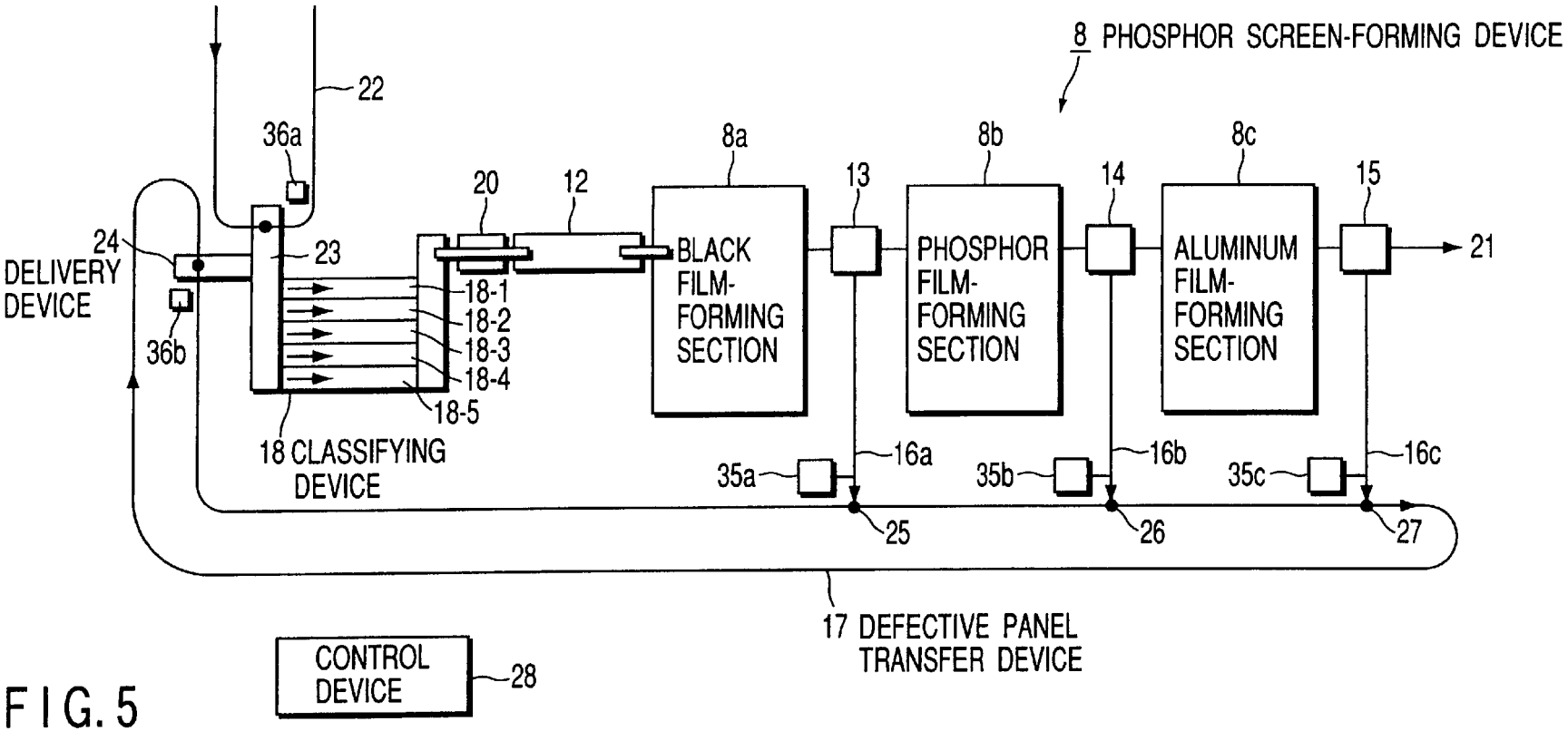
FIG. 5 schematically shows the construction of an apparatus for manufacturing a cathode ray tube according to one embodiment of the present invention.
Figure 10:
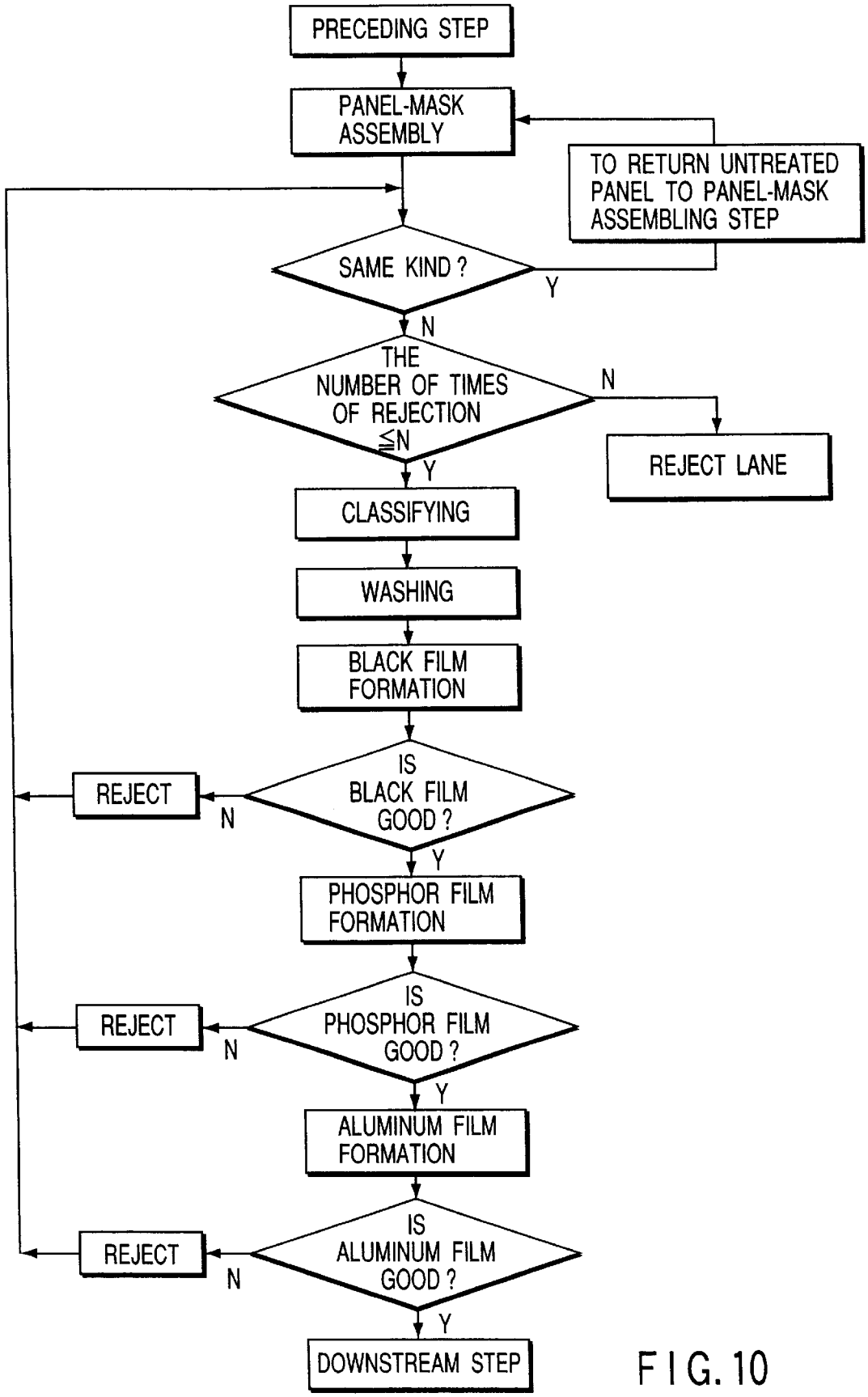
FIG. 10 is a flow chart showing the process for forming a phosphor screen on a panel according to one embodiment of the method of the present invention for manufacturing a cathode ray tube.

Specifically, FIG. 5 schematically shows the construction of an apparatus for manufacturing a cathode ray tube according to one embodiment of the present invention. FIG. 10 shows the flow chart for manufacturing a cathode ray tube.

As shown in FIG. 5, a phosphor screen-forming device 8 constituting a phosphor screen-forming line for forming a pattern of a phosphor screen on the inner surface of a panel is connected to a panel washing device 12 for washing the panel. The phosphor screen-forming device 8 includes a black film-forming section 8*a* for performing a black film-forming step for forming a black film, a phosphor film-forming section 8*b* for performing a phosphor screen-forming step for forming a phosphor film, and an aluminum film-forming section 8*c* for performing an aluminum film-forming step for forming an aluminum film. These film-forming sections 8*a*, 8*b* and 8*c* are connected in series in the order mentioned.

A black film-inspecting device 13 for inspecting whether the black film formed in the black film-forming section 8*a* is satisfactory or not is arranged downstream of the black film-forming section 8*a*. Also, a phosphor film-inspecting device 14 for inspecting whether the phosphor film formed in the phosphor film-forming section 8*b* is satisfactory or not is arranged downstream of the phosphor film-forming section 8*b*. Further, an aluminum film-inspecting device 15 for inspecting whether the aluminum film formed in the aluminum film-forming section 8*c* is satisfactory or not is arranged downstream of the aluminum film-forming section 8*c*.

Rejecting devices 16*a*, 16*b*, 16*c* for automatically rejecting from the phosphor screen-forming device 8 the panels defective in the black film, the phosphor film and the aluminum film are connected to the black film-inspecting device 13, the phosphor film-inspecting device 14 and the aluminum film-inspecting device 15, respectively. The black film-forming section 8*a*, the phosphor film-forming section 8*b* and the aluminum film-forming section 8*c* are connected to a defective panel transfer device 17 via the rejecting devices 16*a*, 16*b*, 16*c*.

The rejecting devices 16*a*, 16*b*, 16*c* are connected to the defective panel transfer device 17 at delivery points 25, 26, 27, respectively. FIG. 5 also shows an unloading passageway 21 for satisfactory panels and a loading passageway 22 for new panels.

Figure 6:
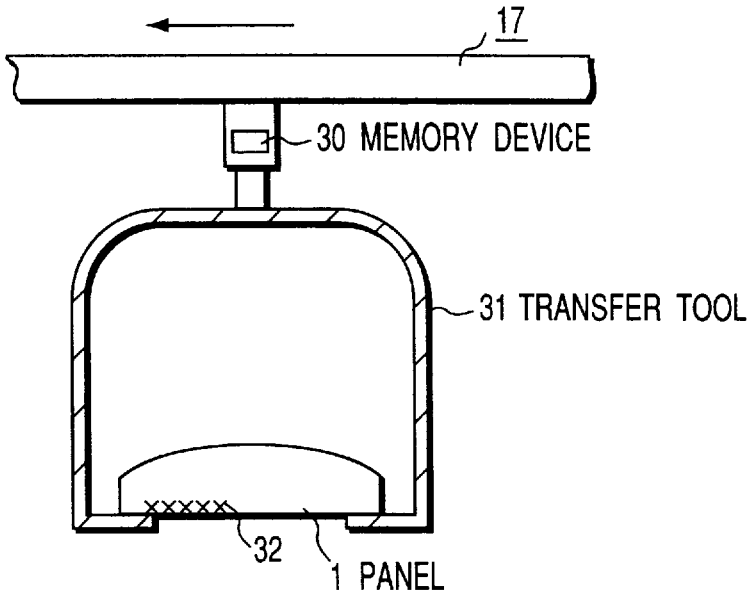
FIG. 6 is a front view showing a defective panel transfer device included in the apparatus for manufacturing a cathode ray tube shown in FIG. 5.

The defective panel transfer device 17 constitutes a returning means of the defective panels rejected from the phosphor screen-forming device 8 back to the black film-forming step. As shown in FIG. 6, the defective panel transfer device 17 includes a hanger 31 acting as a transfer tool. To be more specific, the panels having a black film, etc. formed thereon in the film-forming steps are inspected by the inspecting devices 13, 14, 15 to see whether the films formed on the panels are satisfactory. Where the films have been found to be defective, the panels bearing the defective films are rejected by the rejecting devices 16*a*, 16*b*, 16*c* and held by the hanger 31 at the delivery points 25, 26, 27 so as to be delivered to the defective panel transfer device 17.

The panel delivered to the defective panel transfer device 17 is combined with a shadow mask by a panel-mask assembling device (not shown) and, then, transferred to the inlet port of the black film-forming section 8*a*. The combination of the panel and the shadow mask is hereinafter referred to as "panel-mask".

As shown in FIG. 6, a panel discriminating symbol 32 consisting of characters and/or numerals is recorded in a side surface of the panel 1. The symbol 32 denoting the kind of the panel and an independent number for each panel is printed in the preceding step.

Writing devices 35*a*, 35*b*, 35*c* for writing the panel discriminating symbol 32 of the panel 1 rejected by the rejecting devices 16*a*, 16*b*, 16*c* are arranged in the rejecting devices 16*a*, 16*b*, 16*c*, respectively. Further, a so-called "ID card" 30, i.e., an identity card or an identification card, is mounted as a memory device in the hanger 31 of the defective panel transfer device 17, as shown in FIG. 6. The panel information is written in the ID card 30 by the writing devices 35*a*, 35*b*, 35*c* based on a command from a control device 28. As described previously, the panel information includes, for example, the kind of the panel 1, the number of the panel 1, the number of times of rejection, the type of defect, the panel temperature and the number of the light exposure device used.

On the other hand, a first delivery device 23 acting as a new panel supply means for supplying a new panel-mask transferred from a panel-mask assembling step (not shown) via the new panel loading passageway 22 is arranged in the vicinity of the returning point of the new panel loading passageway 22. Also, a second delivery device 24 acting as a defective panel supply means for supplying in preference to the new panel of the same kind the defective panel-mask rejected by the rejecting devices and transferred by the defective panel transfer device 17 is arranged in the vicinity of the returning point of the defective panel transfer device 17.

The first delivery device 23 is interposed between the loading passageway 22 of the new panel and a classifying device 18. On the other hand, the second delivery device 24 is interposed between the defective panel transfer device 17 and the classifying device 18.

The first delivery device 23 is provided with a reading device 36*a* for reading the panel information at the panel loading section for loading the panel from the new panel loading passageway 22 into the inlet port of the classifying device 18. Likewise, the second delivery device 24 is provided with a reading device 36*b* for reading the panel information at the panel loading section for loading the panel from the defective panel transfer device 17 into the inlet port of the classifying device 18. The panel-mask is loaded into the classifying device 18 by the first and second delivery devices 23 and 24.

The classifying device comprises a plurality of lanes 18-1, 18-2, 18-3 and 18-4 corresponding to the kinds of the panels and a reject lane 18-5 for rejecting the panel-mask which should not be forwarded into the phosphor screen-forming device 8 and is connected to a panel washing device 12 via a separating device for separating the panel and the mask.

The control device 28 controls the operation of each of the rejecting devices 16*a*, 16*b*, 16*c*, the defective panel transfer device 17 and the delivery devices 23, 24. To be more specific, the panel defective in the black film, the phosphor film or the aluminum film is automatically rejected under the control by the control device 28 from the phosphor screen-forming device 8 so as to be transferred by the defective panel transfer device 17. Then, the defective panel is unloaded from the defective panel transfer device 17 by the delivery device 24 so as to be supplied again into the black film-forming section 8*a*. The control device 28 is provided with a central processing device, a memory device, etc.

The control device 28 is provided with a counter for counting the number of times of rejection of the panel based on the panel information read by the reading device 36*b* and serves to inhibit the supply of the panel into the phosphor screen-forming device 8 when the number of times of rejection of the panel has reached a predetermined value.

Where the number of times of rejection has not reached a predetermined value, the panel-mask is taken out of the classifying device 18 in a predetermined order by the control device 28 so as to be supplied into the separating device 20, in which the mask and the panel are separated from each other. Then, the inner region of the panel 1 is washed by the panel washing device 12, and the washed panel is transferred into the black film-forming section 8*a*. On the other hand, the separated mask is transferred to a downstream region by a transfer device (not shown).

Figure 7A:
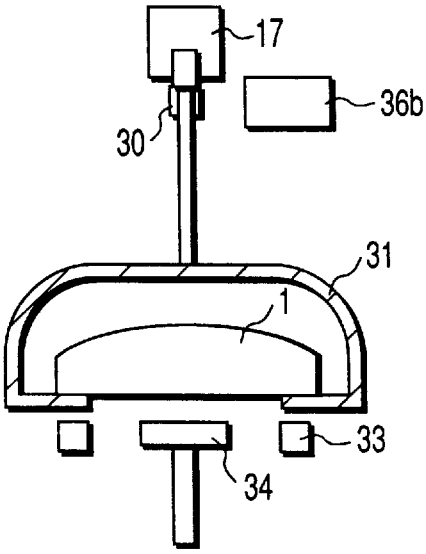
FIGS. 7A, 7B and 7C show how the cathode ray tube panel is loaded in and unloaded from the apparatus for manufacturing a cathode ray tube shown in FIG. 5.
Figure 7B:
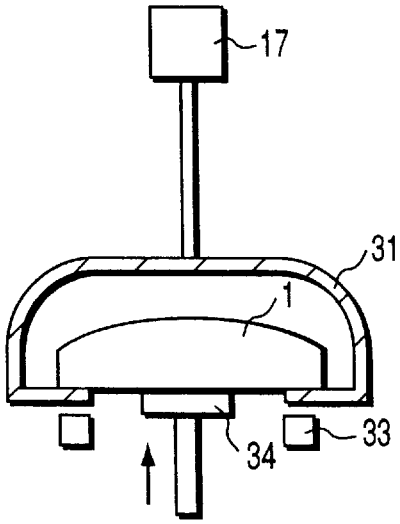
Figure 7C:
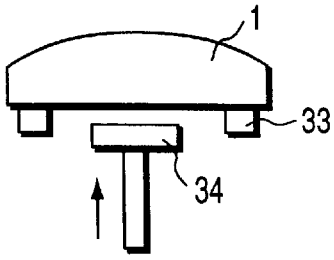

FIGS. 7A to 7C show how the panel 1 is unloaded from the hanger 31 by the delivery device 24 in the defective panel transfer device 17. If the panel 1 carried by hanger 31 is transferred to the unloading point in the defective panel transfer device 17 as shown in FIG. 7A, a lifter 34 is moved upward as shown in FIG. 7B to cause the panel 1 to be moved upward away from the hanger 31. Under this condition, the hanger 31 continues to run to pass through the unloading point. When the reading device 36*b* detects that the hanger 31 has passed through the unloading point, the lifter 34 is moved downward by a signal generated from the control device 28. As a result, the panel 1 is loaded on a conveyor 33 included in the delivery device 24, as shown in FIG. 7C.

It should be noted that the information stored in the ID card 30 mounted to the hanger 31 is read by the reading device 36*b*. Also, the panel 1 loaded on the conveyor 33 is classified in the classifying device 18 by a signal generated from the control device 28 so as to be supplied into a desired lane selected from the lanes 18-1 to 18-5.

Where the defective panel is rejected from the phosphor screen-forming device 8, the panel 1 is moved upward by the lifter 34. When the hanger 31 has arrived at a desired position, the lifter is moved downward to permit the panel 1 to be loaded on the hanger 31. In this step, the information on the panel 1 is written in the ID card 30 by the writing device 35*b*.

As already described, the black film inspecting device 13, the phosphor film inspecting device 14 and the aluminum film inspecting device 15 are mounted downstream of the black film-forming section 8*a*, the phosphor film-forming section 8*b* and the aluminum film-forming section 8*c*, respectively. The inner surface of the panel is inspected by these inspecting devices, and the panel 1 that has been found to be defective is combined with the mask. Then, the panel-mask is loaded on the defective panel transfer device 17 by the rejecting devices 16*a*, 16*b*, 16*c*. In this step, the kind of the panel, the number of the panel, the type of defect and the number of times of rejection are written in the ID card 30 of the hanger 31 by the writing devices 35*a*, 35*b*, 35*c*.

The writing is carried out based on signals supplied from the control device 28 into the writing devices 35*a*, 35*b*, 35*c*. The kind and number of the panel-mask are discriminated by the character or symbol printed on the side wall of the panel. The kind of the defectiveness denotes any of the black film inspecting device 13, the phosphor film inspecting device 14 and the aluminum film inspecting device 15 where the panel was rejected.

Every time the panel is rejected, the number of the rejected panel 1 is stored in the control device 28. If the panel of the same number is rejected, the number of times of rejection is written in the ID card 30 by the writing devices 35*a*, 35*b*, 35*c*. Incidentally, it is possible to read the kind of the panel-mask from a pattern at the end of the horizontal axis of the mask as well as from the character printed on the side wall of the panel.

Then, the rejected panel-mask is transferred by the defective panel transfer device 17 to the inlet port of the classifying device 18.

At the inlet port of the classifying device 18, the information stored in the ID card 30 is read by the reading device 36*b*. Then, the panel-mask 1 is loaded in the inlet port of the classifying device 18 by the second delivery device 24, and is supplied into any of the classifying lanes 18-1 to 18-5 depending on the kind of the panel-mask 1. Where the number of times of rejection exceeds a predetermined value, the panel-mask is supplied into the reject lane 18-5 so as to be prevented from being supplied into the phosphor screen-forming device 8.

A new panel transferred from the preceding step is also loaded by the first delivery device 23. Where the panel-mask loaded by the first delivery device 23 and the panel-mask loaded by the second delivery device 24 are equal to each other in the kind, these panel-masks are to be supplied into the same classifying lane. Therefore, the second delivery device 24 is operated to permit the rejected defective panel-mask to be loaded preferentially into the classifying device 18. In this case, the new panel-mask, which is not loaded in the classifying device 18, is returned to the preceding step.

Figure 8:
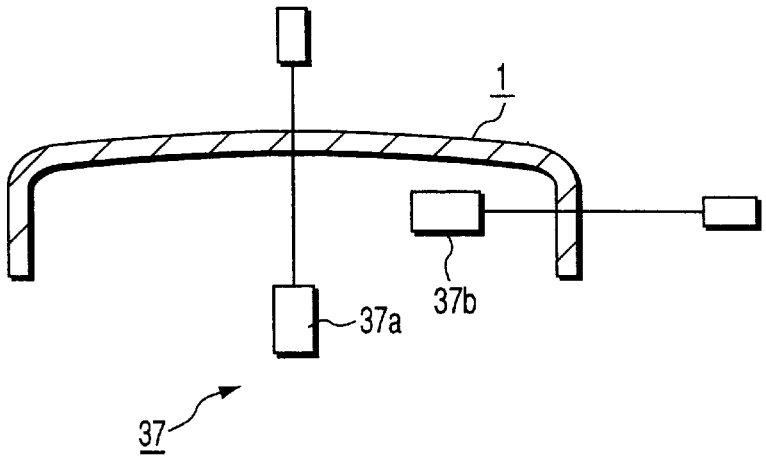
FIG. 8 shows the position of a sensor for determining a defective cathode ray tube panel, said sensor being included in the apparatus for manufacturing a cathode ray tube shown in FIG. 5.

The classifying device 18 is connected to the panel washing device 12 with the separating device 20 interposed therebetween. As shown in FIG. 8, a panel defectiveness discriminating device 37 consisting of a pair of sensors 37*a* and another pair of sensors 37*b* is mounted in the inlet port of the panel washing device 12. The sensors 37*a* serve to inspect the face of the panel, with the sensors 37*b* serving to inspect the side wall of the panel. Depending on the conditions detected by these sensors 37*a* and 37*b*, the kind of the panel can be determined. To be more specific, Table 1 shows the outputs of the sensors included in the panel defectiveness discriminating device 37.

TABLE 1

| kind of panel | sensor 37a | sensor 37b |
|---|---|---|
| new panel | on | on |
| panel defective in black film | on | off |
| panel defective in phosphor film | off | off |
| panel defective in aluminum film | off | on |

As shown in Table 1, the sensors 37*a* and 37*b* are both turned on.when a new panel has been inspected. The sensors 37*a* and 37*b* are turned on and off, respectively, when a panel 1A defective in the black film has been inspected. The sensors 37*a* and 37*b* are both turned off when a panel 1B defective in the phosphor film has been inspected. Further, the sensors 37*a* and 37*b* are turned off and on, respectively, when a panel 1C defective in the aluminum film has been inspected.

In the panel 1A defective in the black film, a black film is formed at a desired pitch on the face. Since the base of the panel is selectively exposed to the outside, light is transmitted through the panel 1A to turn the sensor 37*a* on. On the other hand, the entire region of the side wall portion of the panel 1A is covered with the black film, with the result that the sensor 37*b* is turned off. It follows that the washing condition adapted for the panel can be selected in the panel washing device 12 based on the panel information.

Incidentally, the washing condition adapted for the panel can be selected in accordance with the type of defect written in the ID card by the writing device 35 without using the sensors 37*a*, 37*b*.

FIG. 10 shows a flow chart representing the system described above.

Figure 9:
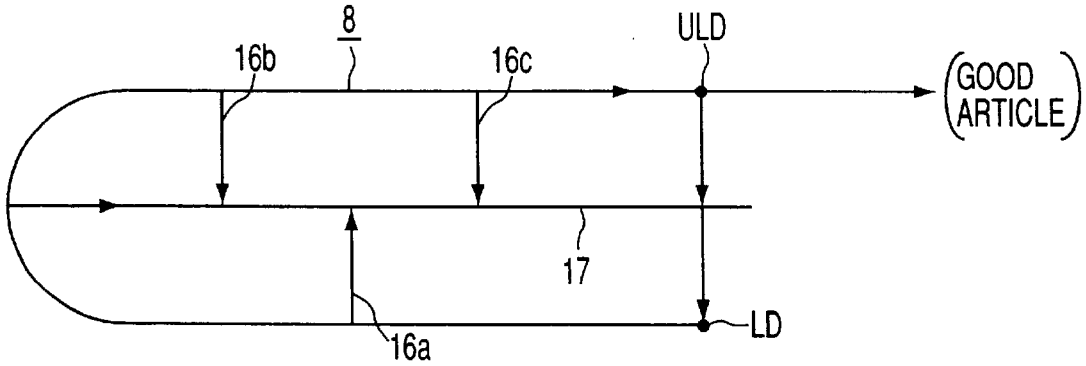
FIG. 9 schematically shows an apparatus for manufacturing a cathode ray tube according to another embodiment of the present invention.

FIG. 9 schematically shows the flow of the panel in the apparatus for manufacturing a cathode ray tube according to another embodiment of the present invention. In the apparatus shown in FIG. 9, a panel transfer line of the phosphor screen-forming device 8 is formed in a U-shape starting from the loading position LD and ending in the unloading position ULD. The defective panel transfer device 17 for recovering the defective panel is arranged in the center of the U-shaped panel transfer line.

The rejecting devices 16*a*, 16*b*, 16*c* for automatically rejecting from the phosphor screen-forming device 8 the panels defective in the black film, defective in the phosphor film and defective in the aluminum film, respectively, are arranged between the defective panel transfer device 17 and the U-shaped panel transfer line.

The new panel transferred from the preceding step is supplied at the loading position LD into the phosphor screen-forming device 8, and a satisfactory panel having a phosphor screen formed thereon in the U-shaped panel transfer line of the phosphor screen-forming device 8 is transferred to the succeeding step from the unloading position ULD. On the other hand, the defective panel rejected by a recovery line from the U-shaped panel transfer line is supplied again to the loading position LD at the head of the U-shaped panel transfer line of the phosphor screen-forming device 8.

The apparatus and method of the present invention for manufacturing a cathode ray tube described above produce prominent effects as summarized below:

(1) The defective panel generated in each step for the phosphor screen formation is automatically brought back to the starting point of the process so as to be supplied again to the phosphor screen-forming process. The particular process permits saving the manual labor.

(2) Since the defective panel is supplied again in preference to the new panel to the phosphor screen-forming process, the panel supplied first to the phosphor screen-forming process can be processed first (first-in and first-out processing). This facilitates supervision of the rejected defective panel. Also, since an extra new panel is returned to the preceding process, a semi-finished product panel is not prepared undesirably.

(3) Where the number of times of rejection exceeds a predetermined value, the rejected panel is prevented from being supplied again into the phosphor screen-forming process. Therefore, the rejected panel is prevented from being uselessly subjected to a phosphor screen-forming process.

(4) Since the washing condition in the panel washing device can be changed in conformity with the kind of the defectiveness of the panel, the washing can be prevented from becoming excessive or insufficient. As a result, the washing can be achieved stably. It is also possible to save the energy used for the washing.

It should also be noted that, since the panel temperature and the manufacturing conditions of, for example, the light exposure device used can be written in the memory device, it is possible to trace the causes of the defective panel.

As described above, the present invention provides an efficient manufacturing system in which the defective panel can be automatically supplied again to the phosphor screen-forming process.

In the embodiment described above, the rejected defective panel is returned to the starting point of the black film-forming step. However, formation of the phosphor screen can be similarly controlled even if the rejected defective panel is returned to the panel-mask assembling step.

As described above, the present invention provides an excellent method of manufacturing a cathode ray tube, in which a phosphor screen can be efficiently formed on a panel that has been judged to be defective. Also, since the rejected defective panel is supplied again in preference to the new panel to the phosphor screen-forming process, the panel that was supplied first to the phosphor screen-forming process is subjected first to the phosphor screen formation.

The present invention also provides an apparatus for efficiently manufacturing a cathode ray tube while suppressing the manual labor, in which the defective panel generated in the black film-forming section, in the phosphor screen-forming section and in the aluminum film-forming section is automatically brought back to the black film-forming section so as to form again a phosphor screen on the panel.

What should also be noted is that, since an extra satisfactory panel is returned to the preceding step, a semi-finished product panel is not prepared undesirably. Further, where the number of times of rejection exceeds a predetermined value, the rejected panel is prevented from being supplied again into the phosphor screen-forming process. Therefore, the rejected panel is prevented from being uselessly subjected to a phosphor screen-forming process. It follows that the present invention provides an apparatus for efficiently manufacturing a cathode ray tube, in which the defective panel is automatically subjected again to a phosphor film-forming process.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming a black film on an inner surface of the washed panel;

inspecting the black film;

automatically rejecting a defective panel having a defective black film from the phosphor screen-forming line;

recycling the defective panel to the starting point of the phosphor screen-forming line;

washing the black film off the defective panel in said washing station; and forming another black film on the inner surface of the panel, wherein at a plurality of occurrences when a recycled panel and an untreated panel are both available at the starting point of the phosphor screen-forming line to enter the phosphor screen-forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

2. A method according to claim 1, where said recycled panel is supplied in preference to an untreated panel that is the same size as the recycled panel.

3. A method according to claim 1, wherein, where a number of times of rejection exceeds a predetermined value of at least one, the rejected panel is not recycled to said phosphor screen-forming line.

4. A method according to claim 1 wherein washing the black film is performed by washing the inner surface of the panel.

5. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming a phosphor film on an inner surface of the washed panel;

inspecting the phosphor film;

automatically rejecting a defective panel having a defective phosphor film from the phosphor screen-forming line;

recycling the defective panel to the starting point of the phosphor screen-forming line;

washing the phosphor film off the defective panel in said washing station; and forming another phosphor film on the inner surface of the panel, wherein at a plurality of occurrences when a recycled panel and an untreated panel are both available at the starting point of the phosphor screen-forming line to enter the phosphor screen forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

6. A method according to claim 5 wherein said recycled panel is supplied in preference to an untreated panel that is the same size as the recycled panel.

7. A method according to claim 5 wherein, where a number of times of rejection exceeds a predetermined value of at least one, the rejected panel is not recycled to said phosphor screen-forming line.

8. A method according to claim 5, wherein washing the phosphor film is performed by washing the inner surface of the panel.

9. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming an aluminum film on an inner surface of the washed panel;

inspecting the aluminum film;

automatically rejecting a defective panel having a defective aluminum film from the phosphor screen-forming line;

recycling the defective panel to the starting point of the phosphor screen-forming line;

washing the aluminum film off the defective panel in said washing station; and forming another aluminum film on the inner surface of the panel, wherein at a plurality of occurrences when a recycled panel and an untreated panel are both available at the starting point of the phosphor screen-forming line to enter the phosphor screen-forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

10. A method according to claim 9, wherein said recycled panel is supplied in preference to an untreated panel that is the same size as the recycled panel.

11. A method according to claim 9 wherein, where a number of times of rejection exceeds a predetermined value of at least one, the rejected panel is not recycled to said phosphor screen-forming line.

12. A method according to claim 9 wherein washing the phosphor film is performed by washing the inner surface of the panel.

13. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming a black film on an inner surface of the washed panel;

inspecting the black film;

automatically rejecting a defective panel having a defective black film from the phosphor-screen forming line;

storing information in memory means on the rejected defective panel;

recycling the defective panel to the starting point of the phosphor screen-forming line;

reading the information stored in advance in the memory means on the rejected defective panel;

washing the black film off the defective panel in said washing station; and forming another black film on the inner surface of the panel, wherein at a plurality of occurrences when a recycled panel and an untreated panel are both available at the starting point of the phosphor screen-forming line to enter the phosphor screen-forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

14. A method according to claim 13, wherein said information on the defective panel includes a number of times of rejection and, where the number of times of rejection of the defective panel read from the memory means exceeds a predetermined value of at least one, the rejected panel is prevented from being recycled again to said phosphor screen-forming line.

15. A method according to claim 13 wherein washing the black film is performed by washing the inner surface of the panel.

16. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming a phosphor film on an inner surface of the washed panel;

inspecting the phosphor film;

automatically rejecting a defective panel having a defective phosphor film from the phosphor screen-forming line;

storing information in memory means on the rejected defective panel;

recycling the defective panel to the starting point of the phosphor screen-forming line;

reading the information stored in advance in the memory means on the rejected defective panel;

washing the phosphor film off the defective panel in said washing station; and forming another phosphor film on the inner surface of the panel, wherein at a plurality of occurrences when a recycled panel and an untreated panel are both available at the starting point of the phosphor screen-forming line to enter the phosphor screen-forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

17. A method according to claim 16 wherein said information on the defective panel includes a number of times of rejection and, where the number of times of rejection of the defective panel read from the memory means exceeds a predetermined value of at least one, the rejected panel is prevented from being recycled again to said phosphor screen-forming line.

18. A method according to claim 16, wherein washing the phosphor film is performed by washing the inner surface of the panel.

19. A method of manufacturing a cathode ray tube, which comprises the steps of:

supplying an untreated panel for a cathode ray tube to a starting point of a phosphor screen-forming line for forming at least one of a black film, a phosphor film and an aluminum film, and including a single washing station;

washing the untreated panel in said washing station;

forming an aluminum film on an inner surface of the washed panel;

inspecting the aluminum film;

automatically rejecting a defective panel having a defective aluminum film from the phosphor screen-forming line;

storing information in memory means on the rejected defective panel;

recycling the defective panel to the starting point of the phosphor screen-forming line;

reading the information stored in advance in the memory means on the rejected defective panel;

washing the aluminum film off the defective panel in said washing station; and forming another aluminum film on the inner surface of the panel, wherein at a plurality of occurrences when a recycled panel and an untreated panel are both available at the starting point of the phosphor screen-forming line to enter the phosphor screen-forming line, in each of said occurrences the recycled panel is automatically selected in preference to the untreated panel to enter the phosphor screen-forming line, said washing station is capable of washing said untreated panel and said recycled panel, and said washing station performs different washing treatments for the untreated panel and the defective panel.

20. A method according to claim 19 wherein said information on the defective panel includes a number of times of rejection and, where the number of times of rejection of the defective panel read from the memory means exceeds a predetermined value of at least one, the rejected panel is prevented from being recycled again to said phosphor screen-forming line.

21. A method according to claim 19 wherein washing the aluminum film is performed by washing the inner surface of the panel.

* * * * *

UNITED STATES PATENT AND TRADEMARK OFFICE

CERTIFICATE OF CORRECTION

PATENT NO. : 6,461,668 B2
DATED : October 8, 2002
INVENTOR(S) : Hirayama et al.

It is certified that error appears in the above-identified patent and that said Letters Patent is hereby corrected as shown below:

Title page,
Item [45], and the Notice information should read as follows:

-- [45] **Date of Patent: *Oct. 8, 2002**

(*) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended of adjusted under 35 U.S.C. 154(b) by 0 days. --

Signed and Sealed this

Twenty-eighth Day of January, 2003

JAMES E. ROGAN
*Director of the United States Patent and Trademark Office*